United States Patent [19]

Calderara et al.

[11] Patent Number: 5,020,997

[45] Date of Patent: Jun. 4, 1991

[54] SAFETY DEVICE FOR SHIELDING OFF THE RECEPTACLES OF AN ELECTRIC CURRENT TAP

[75] Inventors: Ennio Calderara, Cuasso al Piano; Gianmaria Carabelli, Induno Olona, both of Italy

[73] Assignee: Bticino S.r.l., Italy

[21] Appl. No.: 504,924

[22] Filed: Apr. 5, 1990

[30] Foreign Application Priority Data

Jul. 5, 1989 [IT] Italy ..... 21100 A/89

[51] Int. Cl.[5] ..... H01R 13/453

[52] U.S. Cl. ..... 439/137; 439/139

[58] Field of Search ..... 439/136–139

[56] References Cited

U.S. PATENT DOCUMENTS

| | | | |
|---|---|---|---|
| 3,238,492 | 3/1966 | Houston | 439/137 |
| 4,379,607 | 4/1983 | Bowden, Jr. | 439/137 |
| 4,544,219 | 10/1985 | Barkas | 439/137 |
| 4,722,693 | 2/1988 | Rose | 439/139 |
| 4,822,290 | 4/1989 | Cauley et al. | 439/137 |
| 4,867,693 | 9/1989 | Gizienski et al. | 439/137 |
| 4,867,694 | 9/1989 | Short | 439/137 |

*Primary Examiner*—Paula A. Bradley

*Attorney, Agent, or Firm*—Leydig, Voit & Mayer

[57] ABSTRACT

A safety device for shielding off the receptacles of an electric current tap or socket comprises a shutter member guided for sliding movement inside a body against the bias of a spring. The shutter member is disposed between tap holes in a forward cover intended for receiving pins of an electric plug and the tap receptacles. The shutter member is accommodated within the body in tilting support relationship with a back wall of said body which has two oppositely pitched surfaces set at a slight inclination angle which are adapted for blocking the shutter member against sliding movement when a portion thereof is thrust against one of the surfaces.

9 Claims, 3 Drawing Sheets

SAFETY DEVICE FOR SHIELDING OFF THE RECEPTACLES OF AN ELECTRIC CURRENT TAP

DESCRIPTION

This invention relates to a safety device for shielding off the receptacles of an electric current tap or socket, being of a type which comprises a shutter member guided for sliding movement within a tap body against the bias of a spring means between holes intended to receive pins of an electric plug and said receptacles.

As is well known, many countries enforce safety regulations requiring that these devices only make the receptacles of a current tap accessible when the pins of a plug are inserted into the tap simultaneously.

Evident is, therefore, the need for manufacturers of electrical equipment to conform with such regulations by the provision of devices which are practical, effective, and low in cost.

The prior art proposes, for instance, devices which comprise a shutter member interposed between the holes and the receptacles of a current tap. The shutter member is guided, either for a translatory or rotary movement, inside the tap body and against the bias of elastic means, such that it can be shifted from a first position where it shuts off the current tap holes to a second position where free access is given to the receptacles of the tap.

With time, such prior art devices have shown to be generally unreliable. In particular, it may be shown that the incidental introduction of a pointed or flat object through one of the holes frequently results in seizure of the device, whereby its safeguarding function, as provided by the regulatory body, is lost and the pointed object allowed to reach the live interior of the tap.

This problem is the more acute where the pointed object happens to be one of the knife pins of a so-called "American" plug.

Other shortcomings of such prior devices are their complicated design and that they require special care during assembling. All this reflects in increased cost of the device, which goes against the requisite ability to produce it in large volumes at low costs, possibly by the use of automated assembly procedures.

The technical problem that underlies this invention is to provide a novel type of safety device for shielding off the receptacles of an electric current tap or socket which has such structural and performance characteristics as to resist the forcible introduction of a pointed object through just one of the current tap holes, the device having a peculiarly simple construction and a reduced number of component parts so as to obviate the drawbacks noted hereinabove in connection with the prior art.

This problem is solved by a device as indicated being characterized in that the shutter member is housed within a body adjacent an electric current tap in tilting support relationship with a back wall of the body comprising two oppositely pitched surfaces at slight inclination angles, a means being provided of blocking the sliding movement of the shutter member on a portion thereof being brought to bear on one of the surfaces.

In a preferred embodiment, each portion has a ramp-like incline constituting a lead-in for its corresponding plug pin, and is formed integrally with a rod, wherewith said corresponding portion is also integral in a substantially F-like configuration.

The features and advantages of a device according to the invention will become apparent from the following detailed description of an embodiment thereof, given by way of illustration and not of limitation with reference to the accompanying drawings.

Figure 1:
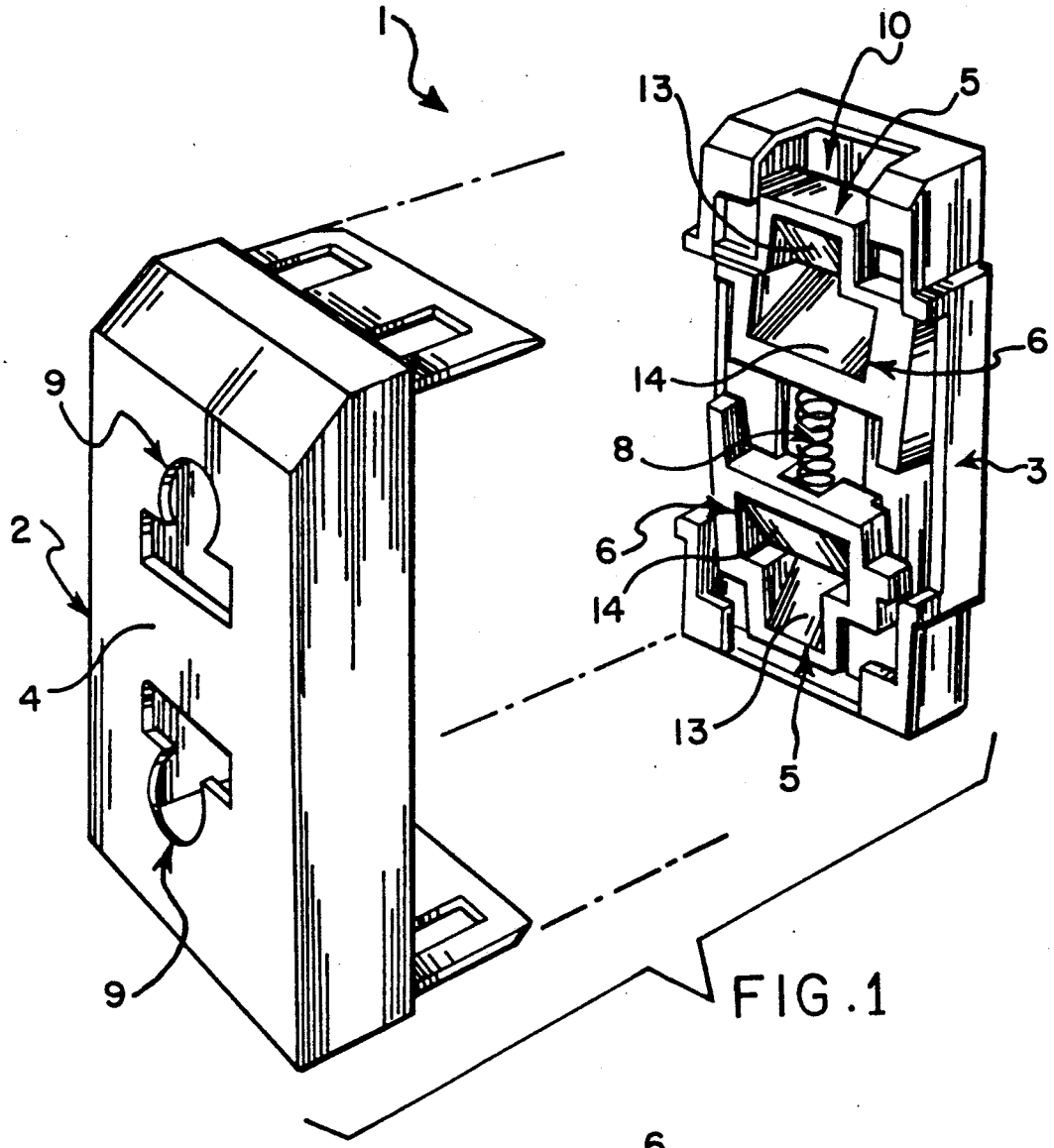
FIG. 1 is an exploded perspective view of an electric current tap safety device incorporating the invention.
Figure 2:
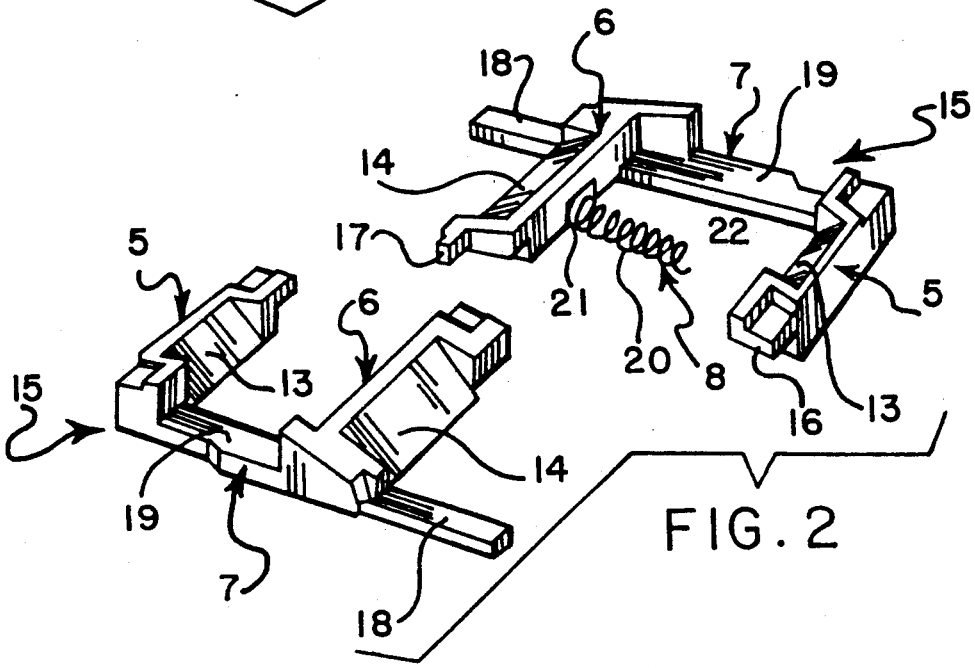
FIG. 2 is an exploded perspective view of the device of this invention.

With reference to the drawing views, generally indicated at 1 is a safety device for shielding off the receptacles, not shown because conventional, of an electric current tap or socket.

In the exemplary embodiment discussed herein, the safety device 1 comprises a body 3 that is mountable adjacent the tap or socket and a cover 2. The cover 2 is of a universal type in the sense that it has holes 9 that can both accommodate plug pins 12 of circular cross-section from an electric plug 11 of the European type and flat pins from a so-called "American" plug, not shown because conventional. It will be understood that the cover 2 is mountable on the body 3 with the holes 9 in alignment with receptacles of the electric current tap or socket.

The body 3 has essentially a box-like design that houses a shutter member 10 which is guided for sliding movement inside the body 3.

The holes 9 of the cover 2 are formed on a front surface portion 4 and the cover is adapted for a snap fit onto the body 3 to act as a cover therefor.

Adjacent each cover hole 9, the shutter member 10 has paired portions 5 and 6 which are constantly urged to abut each other by an elastic means 8.

These portions 5 and 6 are also guided slidably in the body 3 to move away from each other against that same elastic means 8.

Each portion 5 associated with one of the holes is parallel and rigidly connected to the portion 6 correspondingly associated with the other hole of the cover 2.

For this purpose, a rod member 7 is provided perpendicularly to have said portions formed integral therewith and parallel to one another into an F-like configuration.

Each portion, 5 and 6, is provided with an incline of its own, as indicated at 13 and 14, respectively, said inclines forming a lead-in for the insertion of a corresponding plug pin 12.

The portions 5 and 6 differ from each other essentially by the width of their respective ramp-like inclines.

The portions 5 and 6, and their related rod 7, form in combination an assembly, indicated at 15, which constitutes said shutter member 10 in cooperation with a second like assembly 15.

The assemblies 15 are interleaved together such that the free ends 16 and 17 of their corresponding portions 5 and 6 on one assembly 15 will bear slidingly on respective sections 18 and 19 of the rod 7 on the other assembly 15.

Thus, the shutter member 10 is assembled with the portions 6 laid back-to-back centrally of the tap and with the portions 5 extending at diametrically opposite peripheral locations.

The elastic means 8 consists of a cylindrical coil spring which is housed in the body 3 centrally of the latter and in a pre-loaded state with its opposed ends 21 received in corresponding sockets 22 formed centrally in each portion 6 on the remote side from the ramp 14.

Advantageously, within the body 3, the shutter member 10 bears on a back wall 27 defined by two oppositely pitched surfaces 23 and 24 which are set at a slight inclination angle and radiused centrally. The shutter member 10 receives tilting support at the spring 20 along a line of merger between the two surfaces 23 and 24. Each surface, 23 or 24, slopes down toward the periphery of the body 3, and has means arranged at its end section for blocking the sliding movement of the shutter member 10 as a portion of the latter is pushed to bear on one of the surfaces, 23 or 24. Such means consist of respective stepped ledges, indicated at 25 and 26, which are formed integrally with the back wall 27.

Figure 3:
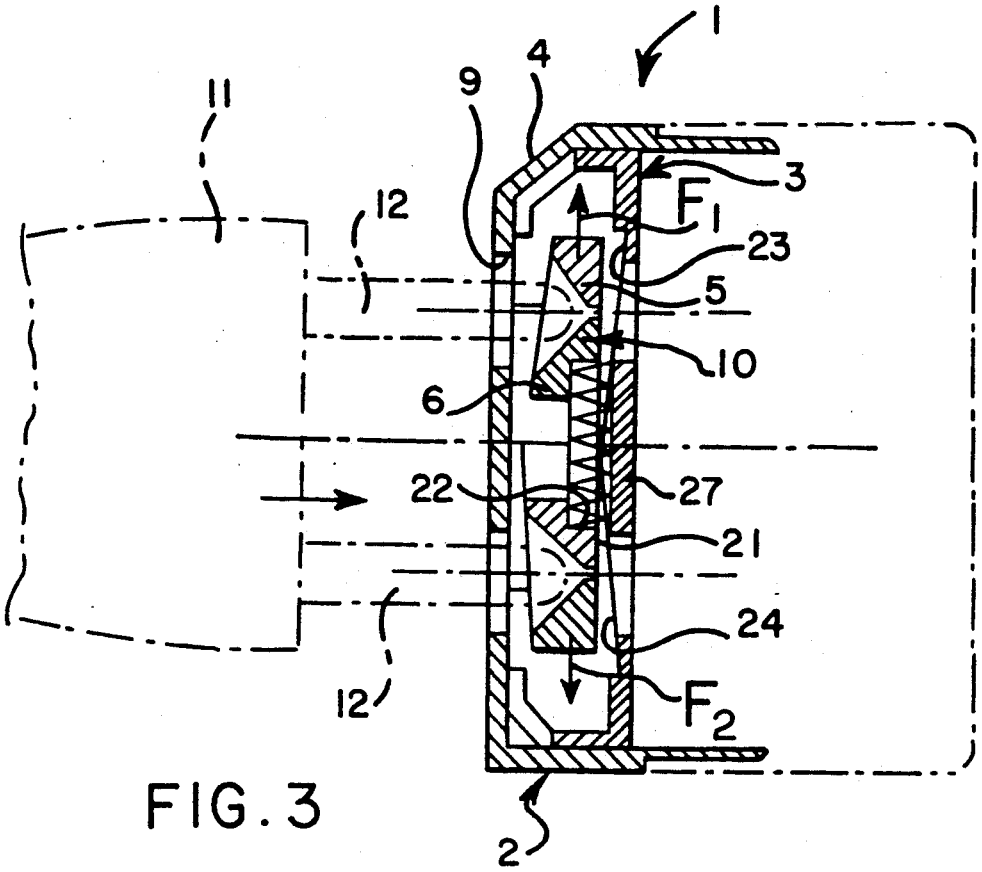
FIGS. 3 to 5 are respective side views, in section, of the safety device shown in FIG. 1 at different stages of its operation.
Figure 4:
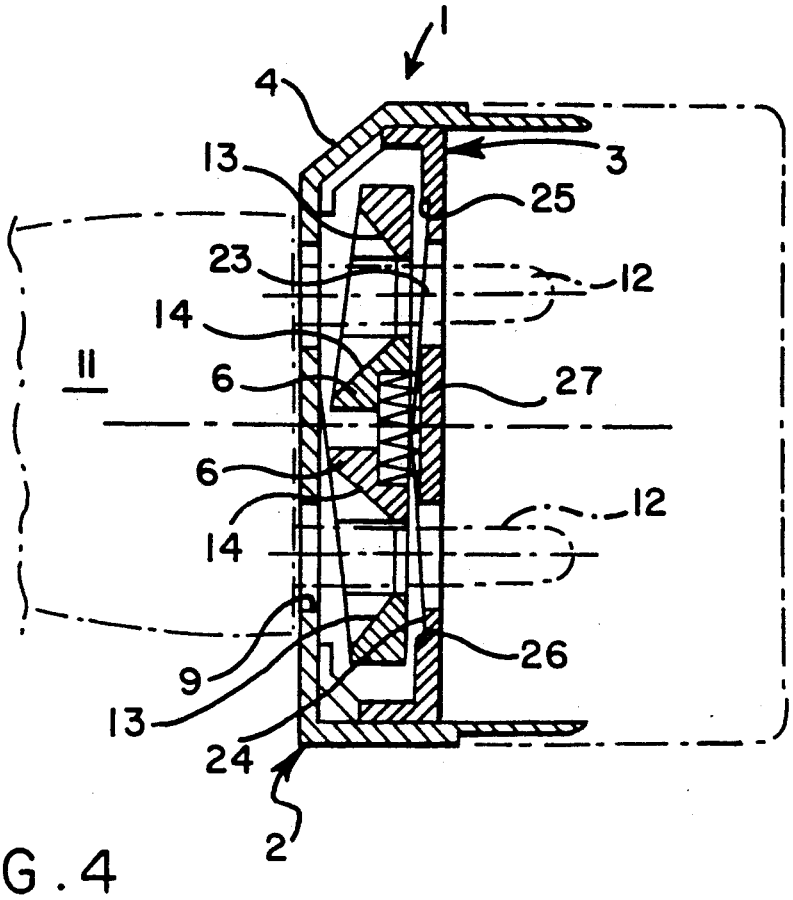

When the pins 12 of the plug 11 are inserted simultaneously through the holes in the cover 2 by a movement in the direction of the arrow F, as shown in FIG. 3, they will concurrently exert a pressure on the ramps 13 and 14 of each pair of confronting portions 5 and 6, forcing them apart and allowing them to move away from each other against the bias of the spring 20.

The portions 5 and 6 fast with each assembly 15 are guided for sliding movement along the same direction, F1 or F2.

Figure 5:
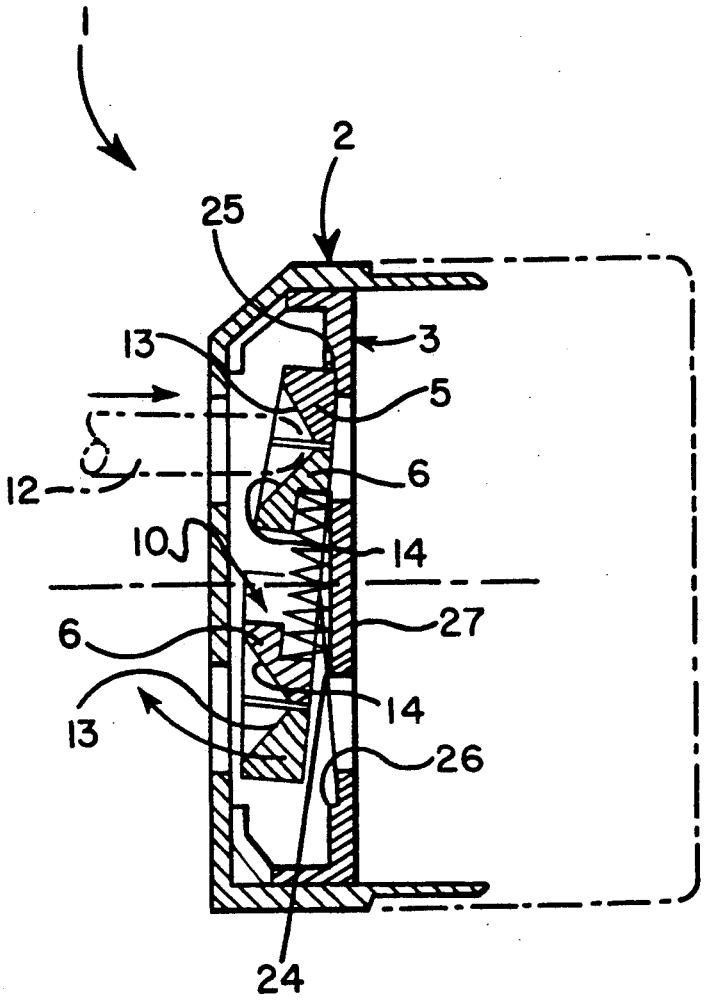

By contrast, should an improper act be performed with some sharp pointed object, such as might result in one of the tap receptacles being reached through a single tap hole as shown in FIG. 5, the thrust force applied through the object would cause a corresponding portion of the shutter member to tilt against one of the sloping surfaces 23 or 24, but with the end of that portion abutted on its corresponding stepped ledge, 25 or 26. Accordingly, the thrust force being applied by the sharp pointed object to the ramps 13 and 14 will result in no displacement of the shutter member held against its ledge as shown in FIG. 5.

The inventive device has proved quite effective to resist the insertion of a pointed and/or flat object through one only of the current tap holes.

This device has a major advantage, moreover, in that its construction is simple and easily assembled such that the device can be assembled using automated equipment.

We claim:

1. A safety device for shielding off the receptacles of an electric current socket comprising a body and means defining holes forwardly of said body and in alignment with said receptacles for receiving pins of an electrical plug, a shutter member mounted for sliding movement within said body at a location between said holes and said receptacles, spring means for biasing said shutter member against said sliding movement, said body having a back wall with two oppositely pitched surfaces at slight inclination angles, said shutter member being supported by said body for relative tilting movement with respect to said back wall pitched surfaces, and means for blocking sliding movement of said shutter member when a portion of the shutter member is brought to bear on one of said pitched surfaces.

2. A device according to claim 1 in which said blocking means comprises respective stepped ledges formed integrally with said back wall at the opposed extremities of said pitched surfaces.

3. A device according to claim 1 in which said hole defining means is a cover removably mountable on a front side of said body.

4. A device according to claim 1 in which said shutter member comprises, located at each said hole, a pair of portions constantly urged to abut each other and which are guided for sliding movement away from each other against the bias of said spring means, each said portion being rigidly connected to its corresponding portion associated with the other said hole.

5. A device according to claim 4 in which each of said portions has a corresponding ramp-like incline, and said inclines of each portion pair face each other into a lead-in for a corresponding pin of said electric plug.

6. A device according to claim 4 in which said spring means consists of a cylindrical coil spring housed in a pre-loaded state centrally of the body with its opposed ends fitting into corresponding sockets formed in portions lying back-to-back.

7. A device according to claim 4 in which said portions are each formed integrally with a rod into an essentially F-like configuration, the corresponding portions with each tap hole being formed on the same rod.

8. A device according to claim 7 in which said portions constitute, in combination with their respective rod, a first assembly adapted to cooperate with their respective rod, a first assembly adapted to cooperate with a second assembly having a similar construction wherewith it is interleaved to define said shutter member.

9. A device according to claim 8 in which said assemblies are interleaved and have the free ends of the corresponding portions in each assembly arranged to bear slidingly on respective sections of the rod in the other assembly.

* * * * *